US009849496B2

(12) United States Patent
Ota et al.

(10) Patent No.: US 9,849,496 B2
(45) Date of Patent: Dec. 26, 2017

(54) PRESS-FORMED PRODUCT, HOT PRESS-FORMING METHOD AND HOT PRESS-FORMING APPARATUS

(71) Applicant: KABUSHIKI KAISHA TOYOTA CHUO KENKYUSHO, Nagakute-shi, Aichi-ken (JP)

(72) Inventors: Eiichi Ota, Nisshin (JP); Atsunobu Murata, Kaizu (JP); Satoru Matsushima, Nagakute (JP)

(73) Assignee: KABUSHIKI KAISHA TOYOTA CHUO KENKYUSHO, Nagakute-shi (JP)

( * ) Notice: Subject to any disclaimer, the term of this patent is extended or adjusted under 35 U.S.C. 154(b) by 559 days.

(21) Appl. No.: 14/228,952

(22) Filed: Mar. 28, 2014

(65) Prior Publication Data

US 2014/0295205 A1 Oct. 2, 2014

(30) Foreign Application Priority Data

Mar. 28, 2013 (JP) ..... 2013-068298
Feb. 4, 2014 (JP) ..... 2014-019859

(51) Int. Cl.

| | |
|---|---|
| ***B21D 22/20*** | (2006.01) |
| ***B21D 37/10*** | (2006.01) |
| ***B21D 22/02*** | (2006.01) |
| ***C21D 8/04*** | (2006.01) |
| ***C21D 1/673*** | (2006.01) |

(52) U.S. Cl.

CPC ..... *B21D 22/20* (2013.01); *B21D 22/02* (2013.01); *B21D 22/208* (2013.01); *B21D 37/10* (2013.01);

(Continued)

(58) Field of Classification Search

CPC ..... B21D 22/208; B21D 37/16; B21D 22/02; B21D 22/20; B21D 37/10; C21D 8/0247;

(Continued)

(56) References Cited

U.S. PATENT DOCUMENTS 7,533,553 B2 * 5/2009 Knaup ..... B21D 22/02 72/342.1
8,671,729 B2 * 3/2014 Verma ..... B21D 37/16 72/342.2

(Continued)

FOREIGN PATENT DOCUMENTS

JP 2005-014002 A 1/2005
JP 2006-192480 A 7/2006

(Continued)

OTHER PUBLICATIONS

May 31, 2016 Notification of Reasons of Refusal issued in JP Application No. 2014-019859.

*Primary Examiner* — R. K. Arundale
*Assistant Examiner* — Mohammad Yusuf
(74) *Attorney, Agent, or Firm* — Oliff PLC

(57) ABSTRACT

A hot press-forming method includes a forming step that clamps a steel sheet heated to a temperature not less than an austenite transformation temperature and press-forms the steel sheet into a desired shape by causing a forming concave of a die and a convex of a punch to be close to each other. A formed portion has side and top portions that merge. The side portion rises up from an inner circumferential edge of a flange portion having been clamped by the die and the blank holder. A cooling step cools a region of the steel sheet after the heating step has been completed and before the forming step is completed. The particular region is along an inter-edge area formed between an opening circumferential edge of the forming concave and a top circumferential edge of the forming convex before the forming step is completed.

8 Claims, 8 Drawing Sheets

P11

(52) U.S. Cl.
CPC ..... *C21D 1/673* (2013.01); *C21D 8/0494* (2013.01); *C21D 2211/008* (2013.01); *C21D 2221/00* (2013.01); *Y10T 428/12389* (2015.01)

(58) Field of Classification Search
CPC .. C21D 9/0062; C21D 8/0494; C21D 8/0294; C21D 2221/10; C21D 2221/00; C21D 2221/02; C21D 1/667; C21D 1/84
USPC ..... 148/644, 639
See application file for complete search history.

(56) References Cited

U.S. PATENT DOCUMENTS 8,839,652 B2 * 9/2014 Kondo ..... B21D 22/208 72/350
2005/0257862 A1 * 11/2005 Asai ..... C21D 1/673 148/654
2005/0268685 A1 * 12/2005 Bolt ..... B21D 24/14 72/351
2007/0017272 A1 * 1/2007 Kurisu ..... B21D 22/022 72/342.2
2007/0235113 A1 * 10/2007 Knaup ..... C21D 8/02 148/643

FOREIGN PATENT DOCUMENTS

| | | |
|---|---|---|
| JP | A-2011-050971 | 3/2011 |
| JP | B2-4681492 | 5/2011 |
| JP | 2011-147970 A | 8/2011 |
| JP | B2-4899529 | 3/2012 |
| JP | B2-5011531 | 8/2012 |

* cited by examiner

PRESS-FORMED PRODUCT, HOT PRESS-FORMING METHOD AND HOT PRESS-FORMING APPARATUS

TECHNICAL FIELD

The present invention relates to a press-formed product obtained by hot press-forming of a steel sheet and also to a hot press-forming method and a hot press-forming apparatus which are suitable for production of the press-formed product.

BACKGROUND ART

Products obtained by press-forming (referred to as "press-formed products") are heavily used in various fields, such as vehicle, home electronics, household furniture and general merchandise fields. A press-formed product can be obtained in general by expanding or drawing a metal sheet, which is clamped by a circumference edge portion of a die and a blank holder (referred also to as "anti-wrinkle holder", etc), between a forming concave of the die and a forming convex of a punch so that the metal sheet is plastically deformed into a desired shape.

By performing such press-forming, members having a complex shape can efficiently be mass-produced. However, when hot-press forming is employed to produce a certain product such as deep-drawn product in which the amount of plastic deformation of the metal sheet is large, some troubles such as breakage and fracture may easily occur at a particular local area to deteriorate the formability. Various proposals have been made to improve the formability, and relevant descriptions are disclosed in Patent Literature (PTL) below, for example.

CITATION LIST

Patent Literature

[PTL 1]
JP Patent No. 4681492
[PTL 2]
JP Patent No. 4899529
[PTL 3]
JP Patent No. 5011531
[PTL 4]
Japanese Unexamined Patent Application Publication No. 2011-50971

SUMMARY OF INVENTION

Technical Problem

PTL 1 proposes a hot press-forming method in which the temperature of a steel sheet is set at 600 degrees C. or less when the forming is initiated and the temperature of the steel sheet is set at a temperature not less than the martensite transformation starting temperature (Ms point) when the forming is completed, and after the forming is completed, a metal press die is utilized to perform heat removal so that quenching is concurrently performed. However, the heated steel sheet contacts partially with the metal die during the forming to have a temperature distribution, and a desired improvement of the formability thus cannot be achieved even if the temperature of the steel sheet as a whole is controlled before the forming. In particular, the amount of deformation during the forming is different depending on the local site, so that the formability can rather deteriorate in accordance with the temperature distribution of the steel sheet.

PTL 2 proposes a method in which a flange portion and the top portion of a punch are heated to 150 degrees C. using an electric heater while an angled R part of the punch and an angled R part of a die are cooled to −20 degrees C. using a coolant, and a ferrite-based stainless steel sheet (JIS SUS430) is warm formed. This allows the angled R part of the punch and the angled R part of the die, which are likely to cause troubles such as fracture and breakage, to have an enhanced proof stress so that the flange portion and the top portion are caused to preferentially deform, and the formability can thereby be improved.

However, the above method is not suitable for hot press-forming of a steel sheet because the steel sheet is difficult to be heated to a high temperature (e.g., 450 degrees C. or more) using an electric heater. In addition, when a commonly-used hot press-forming method is employed, the steel sheet heated to a high temperature is in contact with the angled R part of the punch and the angled R part of the die to be cooled during the forming, thereby intrinsically having a temperature distribution as proposed in PTL 2, in general. Therefore, the forming method as in PTL 2 cannot further improve the formability when performing hot press-forming of a steel sheet.

PTL 3 proposes that a warm deep drawing process for a magnesium alloy sheet can be performed using a combination of direct heating by an induction heating coil and cooling by direct contact with a coolant thereby to improve the critical drawing ratio. However, this method is also difficult, like in PTL 2, to be applied to a commonly-used hot press-forming for a steel sheet because heating the steel sheet to a high temperature cannot actually be achieved and the cooling method is atypical.

PTL 4 proposes that hot press-forming can be performed while a servo die cushion mechanism is used to move the die and the die cushion (blank holder) at a constant speed thereby to obtain a non-contact state where the die and the die cushion (blank holder) are not in contact with a heated steel sheet (material) from the timing of initiating the forming to immediately before completing the forming. This mitigates the temperature decrease at a held portion for anti-wrinkle during the hot press-forming so that material inflow increases from the held portion for anti-wrinkle to a drawing portion thereby improving the formability. PTL 4 also describes that the die cushion and the die, which are stopped immediately before reaching the bottom dead center, clamp/press the held portion for anti-wrinkle to smooth out flange wrinkles and body wrinkles, and quenching is performed at the bottom dead center owing to heat removal into the metal die.

However, even if the temperature decrease at the held portion for anti-wrinkle is merely mitigated as in PTL 4, it cannot be expected to significantly improve the formability. In addition, clearance control using the servo die cushion mechanism is not easy, and it also cannot be expected to improve the forming speed. Further, such a method as in PTL 4 cannot sufficiently smooth out the flange wrinkles because even if the cooperation of the die and the die cushion is stopped at near the bottom dead center to clamp/press the held portion for anti-wrinkle, the clamping/pressing force between the die cushion and the die is about one-fifth to one-tenth the press pressure, in general.

The present invention has been created in view of such circumstances, and objects of the present invention include providing a hot press-forming method that can enhance the formability when performing hot press-forming of a steel sheet, a hot press-forming apparatus suitable for the method, and a press-formed product obtained using the method and/or the apparatus.

Solution to Problem

As a result of intensive studies to solve such problems and repeating trial and error, the present inventors have conceived of partially cooling a particular region that is not cooled by a metal die because of being non-contact with the metal die at least during the initial stage of the forming and is subjected to the forming while remaining in a high temperature and softened state, and also have confirmed that this actually allows the formability to be significantly improved. Developing and generalizing this achievement, the present invention has been accomplished as will be described hereinafter.

«Hot Press-Forming Method»

(1) According to an aspect of the present invention, there is provided a hot press-forming method to obtain a press-formed product. The hot press-forming method comprises: a heating step that heats a steel sheet to a temperature not less than an austenite transformation temperature ($Ac_3$ point); a positioning step that positions the steel sheet between a die having a forming concave and a punch having a forming convex corresponding to the forming concave; and a forming step that press-forms the steel sheet into a desired shape by causing the forming concave of the die and the forming convex of the punch to be close to each other. The steel sheet is held (or clamped) by a blank holder and the die. The punch is inserted in the blank holder. The press-formed product comprises a formed portion. The formed portion has a side portion and a top portion. The side portion rises up from an inner circumferential edge area of a flange portion having been held (or clamped) by the die and the blank holder. The top portion stretches from the side portion. The hot press-forming method further comprises a cooling step that cools a particular region of the steel sheet during a particular time period. The particular region is a region that can become at least a part of the side portion and is along an inter-edge area formed between an opening circumferential edge area of the forming concave and a top circumferential edge area of the forming convex before the forming step is completed. The particular time period is a time period at least after the heating step has been completed and before the forming step is completed.

(2) According to the hot press-forming method (which may be referred to as "forming method") of the present invention, the particular region of the steel sheet, which can become at least a part of the side portion (or referred to as "wall portion", "side wall portion", or "vertical wall portion", etc.) of the press-formed product, is cooled during the particular time period before the forming step is completed. This significantly improves the formability compared with the prior art, and it is thus possible to form a press-formed product etc. having a large forming height (or forming depth), for example, without troubles such as breakage and fracture. Therefore, the forming method of the present invention can be used not only to improve the material formability and productivity of the press-formed products etc, but also to considerably enhance the degree of freedom in the forming.

(3) The reason that the high formability can be obtained according to the forming method of the present invention is as follows. The particular region of the steel sheet to be cooled before completion of the forming step is a region along the inter-edge area formed between the opening circumferential edge area (referred also to as "angled curved part area" or "angled R part area") of the forming concave and the top circumferential edge area (referred also to as "angled curved part area", "angled R part area" or "shoulder part area") of the forming convex. Specifically, the particular region is, at least during the initial stage of the forming step (when the forming step is initiated), a bridge region that lies between the opening circumferential edge area of the forming concave and the top circumferential edge area of the forming convex, or a non-contact region such that it is not in contact (close contact) directly or substantially with any of the die and the punch. In such a particular region, the deformation resistance is small because a high temperature and softened state is maintained at least during the initial stage of the forming step.

In other words, regions other than the particular region, e.g., end portion regions located at both end sides of the particular region, are in a low temperature and hardened state because in general the steel sheet is in contact directly with the opening circumferential edge area of the forming concave of the die and/or with the top circumferential edge area of the forming convex of the punch thereby to be cooled, so that the deformation resistance is large. In addition, such end portion regions also receive frictional resistance due to contact with respective circumferential edge areas of the die and the punch during the forming.

If the press-forming of the steel sheet is performed under such a state, the end portion regions in a low temperature and hardened state may rather be difficult to deform also due to the frictional resistance. For this reason, the deformation force (in particular tensile force) acting on the steel sheet concentrates at the particular region which is in a high temperature and softened state and has a low strength, so that this particular region is most likely to be deformed (i.e., drawn). As such, the prior art hot press-forming method appears to be such that an increased dimension such as an increased forming height causes deformation to be eccentrically present at the particular region of the steel sheet and therefore at the side portion of the press-formed product, and the thickness of that portion may become thin and/or troubles such as breakage and fracture sometimes occur.

In contrast, according to the present invention, the particular region is cooled to be hardened at an appropriate timing (during the particular time period) before the forming step is completed. It appears that the above procedure results in an effect that the deformation force acting during the forming can be distributed to other regions than the particular region to significantly suppress the occurrence of troubles, such as thinning, breakage and fracture, at that portion. In particular, if the temperature at the particular region after the cooling is appropriately adjusted, then the deformation resistance of the particular region can be larger than those of peripheral regions (including frictional resistance). This also allows the peripheral regions to more easily be deformed on a preferential basis rather than the particular region. In this case, material inflow (or plastic flow) may also easily occur from the peripheral regions (regions corresponding to the flange portion and the top portion) to the particular region (region corresponding to the side portion), for example.

In such a way, according to the forming method of the present invention, the regions (portions) being deformed (in particular being drawn) during the forming are distributed to a broad area (the peripheral regions or the flange or top portion) rather than concentrating at a local area (the particular region or the side portion), so that a press-formed product having an increased dimension such as an increased forming height can be formed with an enhanced material formability without causing troubles, such as thinning, breakage and fracture.

« Hot Press-Forming Apparatus »

The present invention can be perceived not only as the hot press-forming method but as a hot press-forming apparatus (which may be referred to as "forming apparatus") suitable for carrying out the method. That is, according to another aspect of the present invention, there is provided a hot press-forming apparatus to obtain a press-formed product. The hot press-forming apparatus comprises: a die having a forming concave; a punch having a forming convex corresponding to the forming concave; a blank holder in which the punch is inserted; and a drive means that drives the die or the punch to cause the forming concave and the forming convex to be close to each other. The press-formed product comprises a formed portion. The formed portion has a side portion and a top portion. The side portion rises up from an inner circumferential edge area of a flange portion clamped by the die and the blank holder. The top portion stretches from the side portion. The hot press-forming apparatus obtains the press-formed product from a steel sheet heated to a temperature not less than an austenite transformation temperature ($Ac_3$ point). The hot press-forming apparatus further comprises a cooling means that can cool a particular region of the heated steel sheet. The particular region is a region that can become at least a part of the side portion and is along an inter-edge area formed between an opening circumferential edge area of the forming concave and a top circumferential edge area of the forming convex.

« Press-Formed Product »

Further, the present invention can be perceived not only as the above-described hot press-forming method and hot press-forming apparatus but as a press-formed product (which may be referred to as "formed product") obtained using the method and/or the apparatus. That is, according to yet another aspect of the present invention, there is provided a press-formed product obtained by hot press-forming of a steel sheet using a die having a forming concave, a punch having a forming convex corresponding to the forming concave and a blank holder in which the punch is inserted. The press-formed product comprises a formed portion. The formed portion has a flange portion, a side portion and a top portion. The flange portion is for being clamped by the die and the blank holder. The side portion rises up from an inner circumferential edge area of the flange portion. The top portion stretches from the side portion. A forming ratio ($100 \times dt/t1$) is 15% or more in a region other than the side portion, wherein the forming ratio is indexed by a ratio of a thickness difference ($dt=t1-t2$) between a maximum thickness (t1) and a minimum thickness (t2) to the maximum thickness.

This forming ratio may be 12% or more, 15% or more, 20% or more, 25% or more, and further 30% or more. The upper limit value of the forming ratio is not particularly limited. Note that the measurement of the thickness according to the present invention is to be performed on the center line (in particular the center line in the lateral direction) of the steel sheet.

« Expansion of the Present Invention »

In consideration of the above-described content, the scope of the present invention can be expanded as follows.

(1) Sheet material is not limited to a steel sheet, and other metal sheets such as aluminum-based sheet, magnesium-based sheet and titanium-based sheet may also be used. Moreover, the heating temperature of the sheet material may also be not more than the hot working temperature (not more than $Ac_3$ point, or further not more than the recrystallization temperature), and warm press-forming can also be employed as substitute for hot press-forming. Note that the term " . . . -based" as used herein means the pure metal or the alloy thereof. In addition, depending on the type of sheet material, the term "quenching" and related terms as used herein may be rephrased as "solution treatment", etc.

(2) The region (or site) to be cooled by the cooling step and the cooling means is not limited to the above-described particular region, and can be expanded to a target region where the deformation resistance during the forming may have to be enhanced. This allows the plastic flow during the forming to be distributed thereby making easy the production of the press-formed product without serious troubles, such as thinning, breakage and fracture, and the formability can thus be enhanced. In general, portions in contact with a metal die during the forming of the heated sheet material are cooled due to heat removal to the metal die (punch or die). Therefore, the above target region may preferably be a region that is not in contact with the metal die at least during the initial stage of the forming.

(3) Thus, the above-described cooling step may be a step that cools a freely-selected region of the heated metal sheet during a particular time period which is a time period at least after the heating step has been completed and before the forming step is completed, for example. Moreover, the above-described cooling means may be a means that can cool the particular region of a metal sheet which is heated merely to any temperature. The heated metal sheet, however, may preferably be a steel sheet heated to a temperature not less than $Ac_3$ point.

« Others »

(1) The "contact" between the steel sheet and the metal die (die, blank holder or punch) is to be determined by whether or not the temperature of the heated steel sheet decreases (falls) to such an extent that affects the hot press-forming ability due to the heat transfer from the heated steel sheet to the metal die. Therefore, the term "contact" as used herein may be rephrased as "close contact".

(2) Unless otherwise stated, a numerical range "x to y" as used herein includes the lower limit value x and the upper limit value y. Various numerical values or any numerical value included in numerical ranges described herein may be freely selected or extracted as a new lower limit value or upper limit value, and any numerical range such as "a to b" may thereby be newly provided using such a new lower limit value or upper limit value.

EMBODIMENTS FOR CARRYING OUT THE INVENTION

Figure 1A:
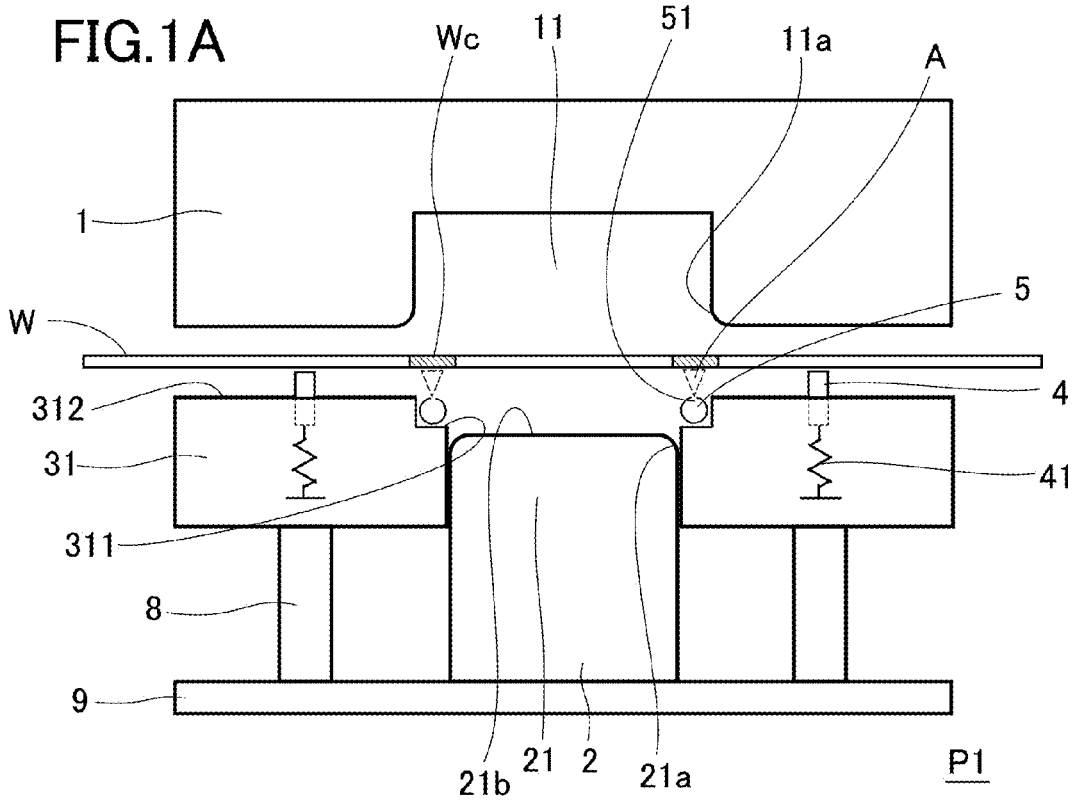
FIG. 1A is a schematic cross-sectional view showing one embodiment of a hot press-forming apparatus according to the present invention.

The content described herein may cover not only the forming method and the forming apparatus but a press-formed product obtained using the method and/or the apparatus. Features regarding the method, when understood as a product-by-process claim, etc, may also be features regarding a product (forming apparatus or press-formed product). One or more features freely selected from the description herein may be added to the above-described features of the present invention. Which embodiment is the best or not may be different in accordance with objectives, required performance and other factors.

«Steel Sheet»

Provided that the steel sheet according to the present invention is an iron alloy that contains carbon (C), the type is not limited. More specifically, the steel sheet may be a commonly-used carbon steel sheet, alloy steel sheet, stainless steel sheet (in particular martensite-based stainless steel sheet), or other appropriate steel sheet. The contained carbon amount (C amount) may be, such as, but not limited to, ordinarily within a range from 0.02 mass % (the unit of "mass %" may be referred simply to as "%") which is the upper limit of solid solution of alpha-ferrite to 2.14% which is the upper limit of solid solution of austenite. In particular, with consideration for the quenching ability, toughness and other necessary properties, the C amount may range from 0.15% to 0.8%, and preferably from 0.2% to 0.7%, when the steel sheet as a whole is 100%. In addition, the steel sheet may preferably contain one or more alloy elements (Cr, Mo, etc.) that facilitate quenching. It should be appreciated that the forming method of the present invention can be used to allow the large size forming, such as large height forming, even if a high strength steel sheet (large C amount steel sheet), such as a high tensile steel sheet, is used.

«Metal Die»

Specific form of the metal die for hot press-forming the heated steel sheet is not limited. The metal die according to the present invention may be enough if it comprises a die (referred also to as "upper die" or "lower die") and a punch (referred also to as "lower die" or "upper die"). The blank holder according to the present invention (referred also to as "anti-wrinkle holder", including one or more die cushions in some cases) may be enough if it can hold the outer circumference (flange portion) of the formed portion when the steel sheet is press-formed. The die and the punch are enough if at least either one is driven.

«Forming Method»

(1) Heating Step

The heating step according to the present invention is a step that heats the steel sheet to a temperature not less than the austenite transformation temperature ($Ac_3$ point). The heating method may be, such as, but not limited to, heating in a furnace, high-frequency heating, or other appropriate heating. The heating temperature being not less than the $Ac_3$ point allows the heat removal from the metal die during the forming, so that the quenching can be completed at the same time with the completion of the forming (direct forming).

(2) Positioning Step

The positioning step according to the present invention is a step that positions the steel sheet heated by the heating step between the die and the punch. In this operation, if the steel sheet contacts with the die or the punch, then heat removal occurs from the steel sheet via the contact area to reduce the temperature of the contact area, thus negatively affecting the formability of the steel sheet as a whole. Therefore, at least the positioning step according to the present invention before the cooling step may preferably be a non-contact holding step that holds the steel sheet after the heating step so that the steel sheet does not contact (closely contact) substantially with any of the punch and the blank holder to have an almost uniform temperature as a whole.

(3) Cooling Step (Cooling Means)

The cooling step according to the present invention is a step that cools a portion of the heated steel sheet (dangerous portion), which would be drawn (plastically deformed) still in a high temperature softened state to cause some troubles such as breakage if being formed without any countermeasure, thereby to obtain a lower temperature hardened state.

It may be enough if the cooling step is performed during at least a suitable time period after the heating step has been completed and before the forming step is completed (particular time period), and the timing, cooling time and cooling temperature, etc. are not limited. However, the particular region as a cooling target is likely to change its form during the forming, and it is thus preferred that the cooling step is performed before the start of the forming step in which the particular region is easily determined, or at around a time when the forming step is started.

Specific method of cooling the particular region is not limited. For example, the cooling step may be a coolant supply step that supplies a coolant to the particular region or a cold body contacting step that causes a cold body (e.g., contact metal) to contact with the particular region. The coolant supply step may be performed, for example, by feeding (blowing or flowing) the coolant (gas or liquid) from a coolant supply pipe (cooling means) provided around the outer circumference side of the punch to the particular region. The cold body to be used in the cold body contacting step may also be provided around the outer circumference side of the punch, for example. It is preferred that, except for during the cooling step (e.g., in the forming step), the coolant supply pipe and the cold body are accommodated in the metal die (e.g., in the die or in the blank holder) in a state of not effecting, such as contacting with and interfering, the steel sheet.

Adjustment may appropriately be performed for the type, supply amount, direction, temperature, supplying time and other parameters relevant to the coolant to be supplied from the coolant supply pipe, or the type (material), heat capacity, temperature before contact, contacting time and other parameters relevant to the cold body. This allows the heated steel sheet to have a desired temperature distribution (for example, to have a temperature difference of 10 to 450 degrees C. between different regions) within a broad region including the particular region. Such a coolant may be air, for example, which provides economic advantages. When the cooling means is configured such that a fluid such as air is sprayed, the position, size (aperture diameter) and direction of the spraying opening (hole) and the temperature of coolant, etc, may appropriately be adjusted.

If the particular region is unduly cooled to the martensite transformation starting temperature (Ms point) or less in the cooling step, then the particular region is quenched before the forming so that the formability unfortunately deteriorates. Therefore, the cooling step according to the present invention may preferably be a step that causes the particular region of the steel sheet to be at a particular temperature higher than the Ms point.

(4) Forming Step

The forming step according to the present invention is a step that press-forms the steel sheet, of which the particular region has been cooled in the above-described cooling step, into a desired shape by holding the steel sheet using the die and the blank holder to be inserted therein with the punch so that the forming concave of the die and the forming convex of the punch come close to each other. Provided that the cooling step is performed, the flange region of the heated steel sheet may remain in being clamped directly by the blank holder and the die during from the start to the end of the forming.

To further enhance the hot press-forming ability, however, it is preferred that the material inflow easily occurs toward the particular region to be cooled, from the flange region (outer circumference region of the opening circumferential edge area of the forming concave) surrounding the particular region. To this end, the forming step according to the present invention may preferably be a heat removal suppressing forming step that performs the press-forming while suppressing heat removal from the flange region of the steel sheet to be the flange portion to the die or the blank holder. In addition, the hot press-forming apparatus according to the present invention, as will be described later, may preferably have a heat removal suppressing means that suppresses the heat removal. The above step and means can suppress the temperature decrease and therefore the hardening of the flange region of the steel sheet so that the amount of material inflow increases from the flange region of the steel sheet to the particular region thereby to further enhance the formability.

According to the inventors' intensive studies, considerably enhanced formability has been obtained by performing for the same period of time both the cooling of the particular region and the suppression of temperature fall at the flange region as described above, compared with the case where the both are performed independently. This can be considered as below. First, the cooling step according to the present invention cools the particular region to significantly increase the forming depth (height), so that the time period for material to flow into the particular region from the flange region also increases. Next, the particular region is cooled to be in a hardened state while the flange region is suppressed its temperature fall to be in a softened state, and a situation is thus obtained where the material can easily flow into the particular region from the flange region. It appears that these factors act synergistically to thereby allow a hot press-formed product having a significantly large forming depth to be obtained beyond an effect merely in an additive manner of the cooling of the particular region and the suppression of temperature fall at the flange region.

In any case, according to the present invention, even if the direct forming is performed, a hot press-formed product can be obtained which has a significantly large forming depth (forming height), and the applicable fields for the hot press-formed product can therefore be expanded drastically. As will be understood from the above-described acts and advantageous effects, the hot press-forming method of the present invention can be applied widely to press-forming of a heated sheet material regardless of the material and heating temperature.

Various types of methods may be possible to suppress heat removal from the flange region of the heated steel sheet to the metal die (die and blank holder) for the purpose of suppressing the temperature fall at the flange region. For example, a heater or the like may be embedded in a metal die region that can be in contact with the flange region thereby to heat or keep the temperature of the flange region of the steel sheet. In an alternative embodiment, the forming speed may be increased to substantially reduce the time for contact between the flange region of the steel sheet and the metal die (and therefore the time for heat removal) thereby to achieve the suppression of temperature fall at the flange region. In this case, the number of shots (the number of forming operations) per one minute may be 10 spm (shot per minute) or more, preferably 15 spm or more, and more preferably 20 spm or more.

In a further embodiment, during at least a part of the time period for the forming, the metal die and the flange region of the steel sheet may be in a non-contact state or in a non-close-contact state. This allows the suppression of temperature fall to be performed simply and efficiently. Therefore, the heat removal suppressing forming step according to the present invention may preferably be a non-clamping/pressing forming step that performs the press-forming without clamping/pressing the flange region of the steel sheet by the die and the blank holder.

Such a non-clamping/pressing forming step may be performed by various methods. For example, the die and the blank holder may be controlled and driven using a servo mechanism so that the steel sheet and the metal die do not contact with each other at the flange region. In an alternative embodiment, one or more distance blocks may be disposed between the die and the blank holder. In this case, the clearance between the die and the blank holder can easily be controlled at the flange region of the street sheet by adjusting the thickness of the distance blocks. Moreover, this configuration is simple and can contribute to the high speed forming because the distance blocks are merely disposed. Therefore, the non-clamping/pressing forming step according to the present invention may be a forming-with-gap step that performs the press-forming by using the distance blocks and the like to set a gap between the die and the blank holder for the flange region of the steel sheet, wherein the gap is larger than the sheet thickness of the steel sheet.

However, if the forming-with-gap step is performed using the distance blocks and the like, the flange region of the steel sheet is not sufficiently held by the die and the blank holder to remove wrinkles, so that such wrinkles may easily occur at least at the flange portion of the press-formed product (flange wrinkles). Even if such flange wrinkles occur, no wrinkle at the formed portion (i.e., absence of so-called body wrinkle) may cause no problem, but no flange wrinkle will be preferable in general. Therefore, the present invention may preferably further comprise a smoothing step that removes the gap, such as by removing the distance blocks, after the forming-with-gap step and clamps/presses the flange region of the steel sheet by the die and the blank holder to smooth out wrinkles (flange wrinkles) caused at the flange region.

To ensure to mitigate or vanish the flange wrinkles, the smoothing step may preferably be a strongly pressing step that restrains movement of the blank holder at near a stopping position of the die or the punch (near the bottom dead center or the top dead center) to strongly press the flange region of the steel sheet (or the flange portion of the press-formed product) by the die and the blank holder.

The restraint of the blank holder (die cushions) at near the stopping position can be performed, for example, by interposing one or more blocks (stopper blocks) having an appropriate height between the blank holder and a base (base plate, etc.) on which the blank holder is placed. In this case, when the blank holder contacts with the stopper blocks to stop, a press pressure far beyond the die cushion pressure acts on the flange portion being clamped between the die and the blank holder, so that the flange wrinkles can further certainly be vanished.

(5) Quenching

When the quenching is to be completed concurrently with the forming, the steel sheet may have to be heated to an initial temperature not less than the $Ac_3$ point in the heating step, and the formed portion comprising at least the side portion and the top portion may have to be at an end temperature lower than the Ms point when the forming step is completed. Preferable initial temperature and end temperature may be different depending on the composition of the steel sheet and the form of the formed portion, etc. For example, the initial temperature may be 850 degrees C. or more, and preferably 900 degrees C. or more, while the end temperature may be 400 degrees C. or more, and preferably 450 degrees C. or more.

In the present invention, the metallo graphic structure of the press-formed product is not limited, but the product as a whole having a quenching structure may be preferable because of having a high strength. While it is possible to perform heat treatment of the press-formed product independently, the heat treatment (quenching) can efficiently be performed concurrently with the forming by controlling the steel sheet temperature (and further the cooling speed) at the time of the press-forming, as described above. As will be appreciated by a person skilled in the art, the quenched structure referred to in the present invention is not limited to being a single phase of martensite structure, but may be a mixed structure that contains bainite structure, ferrite structure, cementite structure, and/or other appropriate structures. It is preferred that quenched press-formed products are tempered as necessary.

« Hot Press-Forming Apparatus »

Figure 3A:
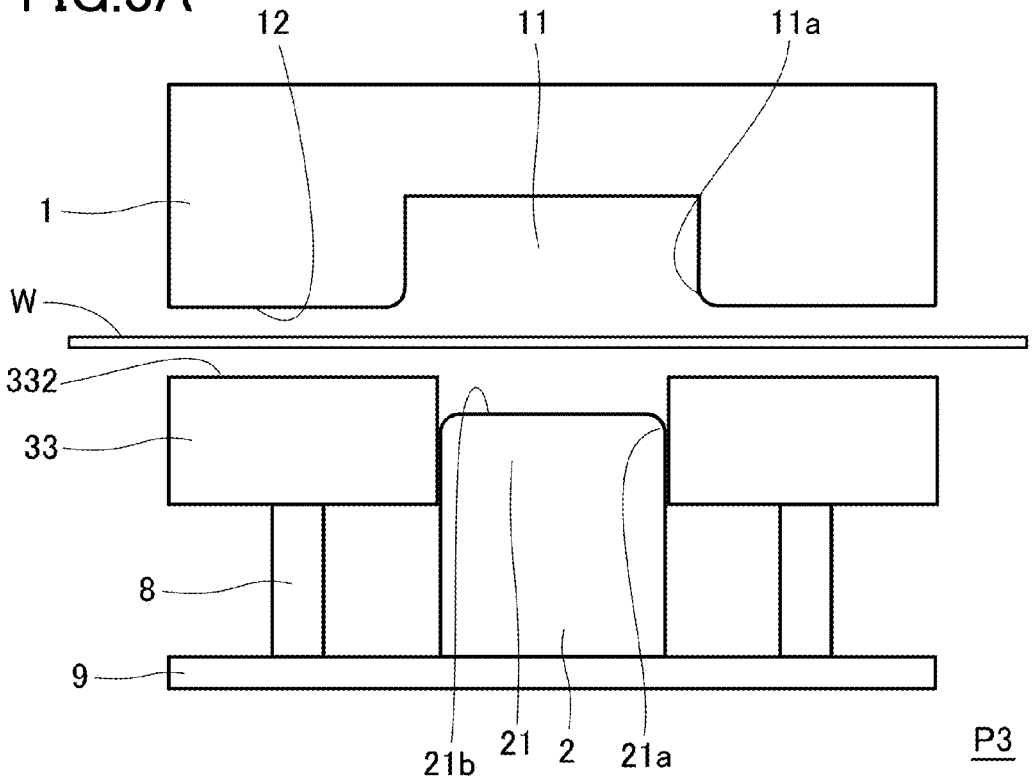
FIG. 3A is a schematic cross-sectional view showing a conventional hot press-forming apparatus.

(1) First, FIG. 3A shows a conventional hot press-forming apparatus (referred simply to as "forming apparatus") P3. The forming apparatus P3 comprises: a die 1 and a punch 2 that constitute a forming metal die; a blank holder 33 arranged to face the die 1; one or more die cushions 8 that support the blank holder 33 so that the blank holder 33 can move up and down; and a base 9 that supports the die cushions 8. The punch 2 is fixed to the base 9.

The die 1 has a forming concave 11 of which the opening circumferential edge area forms an angled curved part (angled R part) 11*a*. The punch 2 has a forming convex 21 of which the top circumferential edge area forms a shoulder part 21*a* having an angled curbed shape (angled R shape). The die 1 and the punch 2 move up and down relative to each other thereby to cause the forming concave 11 and the forming convex 21 to be in a loose fit state. When using the forming apparatus P3, a steel sheet W is grasped such as by a robot arm (not shown) and positioned between the die 1 and the punch 2 or the blank holder 33 (positioning step).

Figure 3B:
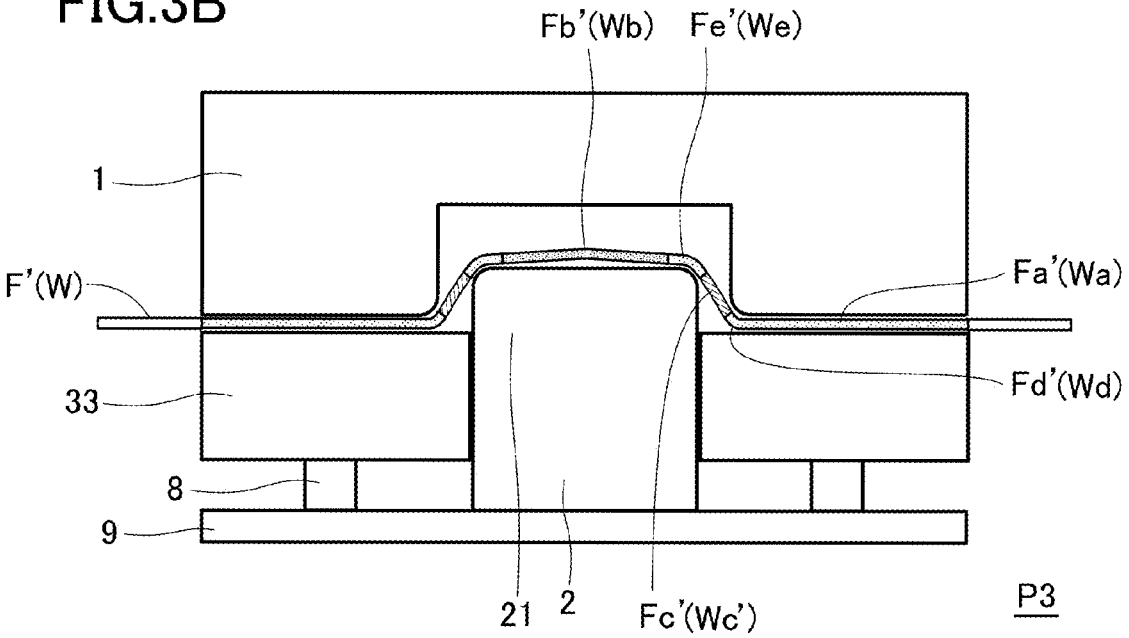
FIG. 3B is a schematic view showing an appearance to perform hot press-forming using the same.

FIG. 3B shows an appearance that the steel sheet W heated is hot press-formed by the die 1 and the punch 2 of the forming apparatus P3. In the forming apparatus P3, the die 1 is first driven from above by a hydraulic press machine (drive means) to move downward. As the die 1 moves downward, the steel sheet W is clamped between the lower end flat surface 12 of the die 1 and the upper end flat surface 332 of the blank holder 33. This clamped portion (Wa) of the steel sheet W is to be a flange portion Fa' of a finally obtained press-formed product F'.

As the die 1 further moves downward in the state where the steel sheet W is clamped, the blank holder 33 is pushed down by the die 1 to move downward along the die cushions 8. In coordination with this downward movement of the blank holder 33, the forming convex 21 of the punch 2 initiates moving relatively toward the forming concave 11 of the die 1. Immediately before the top surface 21*b* of the forming convex 21 of the punch 2 is almost flush with the upper end flat surface 332 of the blank holder 33, the shoulder part 21*a* of the forming convex 21, which merges into the top surface 21*b*, contacts with the steel sheet W. With this contact state, the forming convex 21 charges relatively into the forming concave 11, and the portion (We) of the steel sheet W finally in contact with the shoulder part 21*a* is to be a corner portion Fe' of the press-formed product F'.

Coordinating with the contact with the shoulder part 21*a*, the steel sheet W also contacts with the angled curved part 11*a* of the forming concave 11. With this state, the forming convex 21 charges relatively into the forming concave 11, and the portion (Wd) of the steel sheet W finally in contact with the angled curved part 11*a* is to be an angled portion Fd' of the press-formed product F'.

As the charging of the forming convex 21 into the forming concave 11 progresses, the steel sheet W is formed with a bridge region Wc' (particular region) that bridges a region (inter-edge area) between the angled curved part 11*a* and the shoulder part 21*a*. This bridge region Wc' is finally to be a side portion (vertical wall portion) Fc' of the press-formed product F. As found from FIG. 3B, the bridge region Wc' is a non-contact region that is not in contact with the die 1 and the punch 2 during the forming, so that this region is in a softened state of a higher temperature than those of other regions, i.e., the flange region Wa, the angled region Wd and the corner region We, and the deformation resistance thus deteriorates. In addition, the bridge region Wc' is a portion that may easily be deformed (drawn) in a larger scale than those of other portions, such as the top region Wb (portion to be the top portion Fb' of the press-formed product F'), as the forming convex 21 progresses into the forming concave 11. Thus, in the conventional forming apparatus P3, plastic deformation would concentrate in the bridge region Wc' to be likely to cause troubles, such as breakage and fracture, at the corresponding side portion Fc' of the press-formed product F.

(2) Next, FIG. 1A shows a forming apparatus P1 as one embodiment according to the present invention. Similar components to those in the forming apparatus P3 shown in FIG. 3A are denoted by the same reference characters, and the detailed explanation is omitted (here and hereinafter). The forming apparatus P1 differs from the forming apparatus P3 in the point that the former comprises holding pins 4 and an air pipe 5.

The plural holding pins 4 are arranged at a regular interval at the upper end flat surface 312 side of the blank holder 31 to be retractable with respect to the upper end flat surface 312. Specifically, each holding pin 4 is biased by a spring 41 (elastic body) accommodated in the blank holder 31, and the holding pins 4 are in a state of protruding from the upper end flat surface 312 when the die 1 is not moved down. The holding pins 4 in such a state of protruding allow the heated steel sheet W to be held without contact with the blank holder 31 (positioning step, non-contact holding step), and the initial heated state can thus be substantially maintained.

When the die 1 moves downward, it presses the holding pins 4 via the steel sheet W so that the holding pins 4 are retracted into the blank holder 31. In such a manner, the steel sheet W is clamped between the die 1 and the blank holder 31 (see FIG. 1B).

Figure 1B:
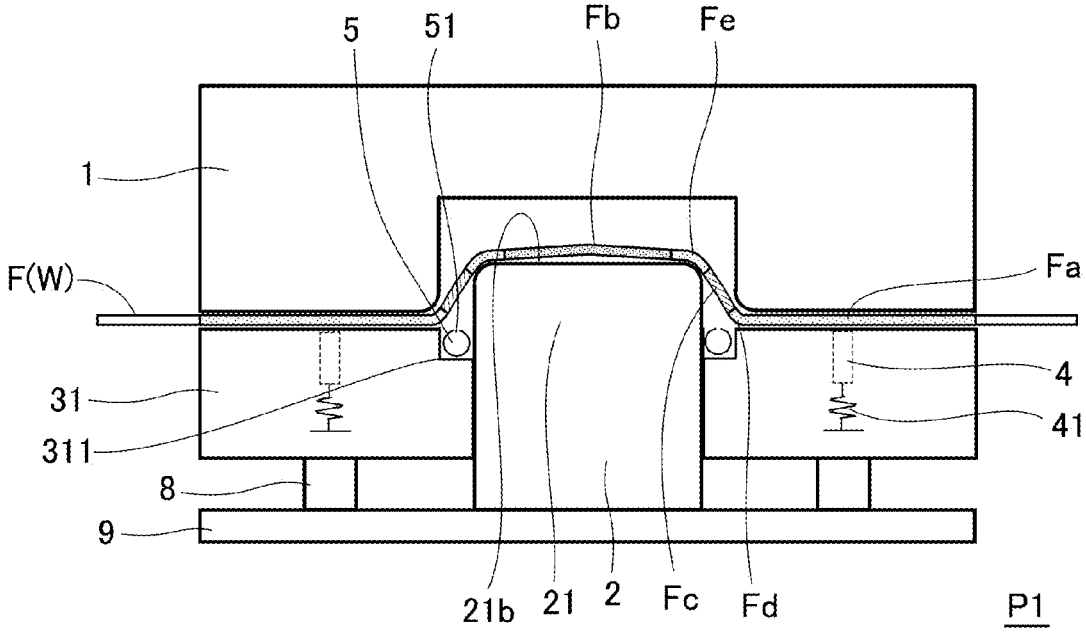
FIG. 1B is a schematic view showing an appearance to perform hot press-forming using the same.

The air pipe 5 (coolant supply pipe, cooling means) is accommodated along a circular stage 311 formed at the upper inner circumference side of the blank holder 31. At the upper face side of the air pipe 5, plural small holes 51 are opened at a regular interval. Into the air pipe 50, air (coolant) can be fed by pressure from an air-compressor (not shown). The timing, the amount of air and the like when feeding air into the air pipe 5 may be controlled by a control valve (not shown). In addition, as shown in FIG. 1B, the air pipe 5 is configured such that, when the forming convex 21 charges into the forming concave 11, the air pipe 5 is located between the outer circumference side of the forming convex 21 and the wall of the stage 311. This prevents the air pipe 5 from interfering with the steel sheet W and other components even during the forming. Note that the blank holder 31 of the forming apparatus P1 differs from the blank holder 33 of the forming apparatus P3 in the point of having the stage 311.

In the forming apparatus P1, when the steel sheet W is placed on the holding pins 4, air is sprayed from the air pipe 5 toward the bridge region Wc (particular region) of the heated steel sheet W (cooling step, coolant supply step). The bridge region Wc is thereby cooled before the forming and caused to be in a state of being hardened due to a lower temperature than those of peripheral regions, i.e., a state of increased deformation resistance. When the steel sheet W in this state is press-formed as shown in FIG. 1B (forming step), plastic deformation does not concentrate in the bridge region Wc, unlike the case of the forming apparatus P3. Further, the flange region Wa and the top region Wb are also drawn via the bridge region Wc, the angled region Wd and the corner region We. In such a way, the steel sheet W deforms uniformly by plastic deformation between the forming concave 11 and the forming convex 21.

Therefore, the forming apparatus P1 according to the present invention can be used to suppress troubles, such as thinning, breakage and fracture, at the bridge region Wc and therefore at the side portion Fc of the press-formed product F, thus improving the deformability. It should be appreciated that the steel sheet W is in contact with the shoulder part 21*a* of the forming convex 21, and the top region Wb (portion to be the top portion Fb of the press-formed product F) located at the middle is likely to be in a non-contact state (floated state) from the top surface 21*b* of the punch 2. As a consequence, at least during the initial stage of the forming, less heat removal occurs into the punch 2 from the top region Wb, which is therefore in a state of high temperature to be easily deformed.

Figure 2:
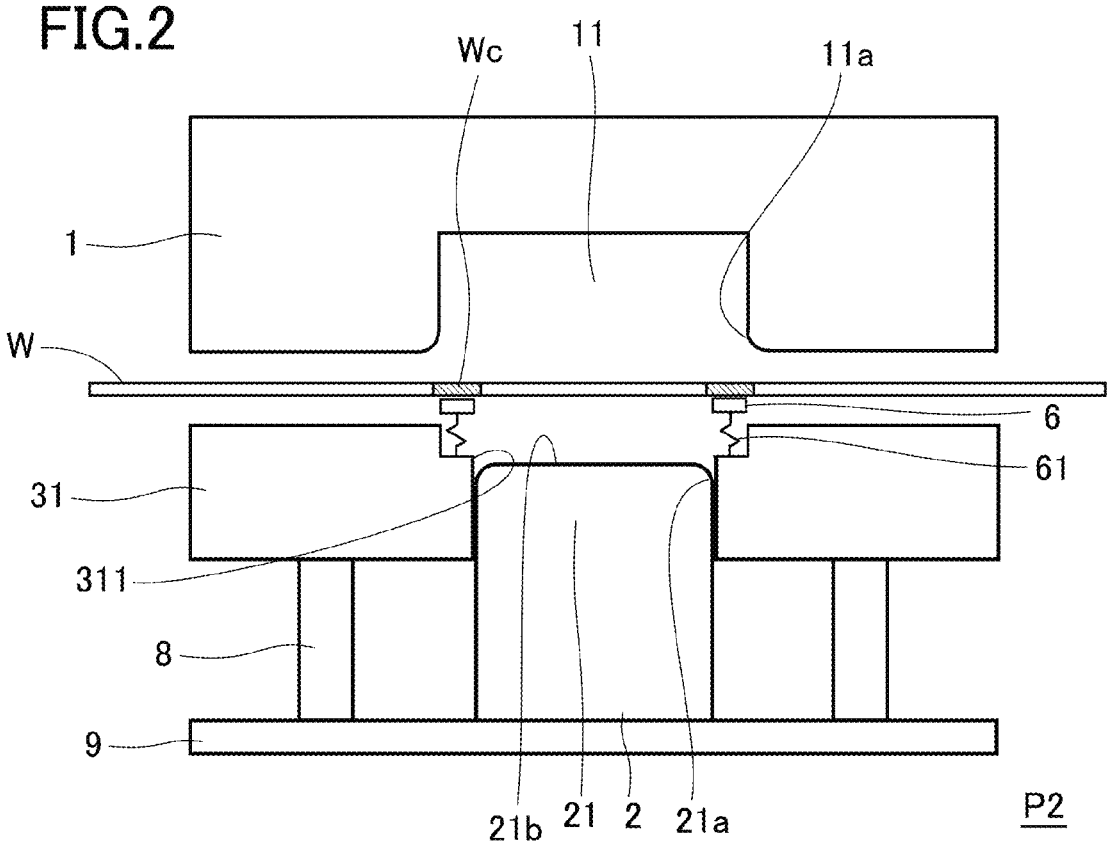
FIG. 2 is a schematic cross-sectional view showing another embodiment of a hot press-forming apparatus according to the present invention.

(3) Further, FIG. 2 shows a forming apparatus P2 as another embodiment according to the present invention. In the forming apparatus P2, the air pipe 5 is substituted by a contact metal 6 (cold body, cooling means) and the holding pins 4 and the springs 41 are omitted in comparison with the forming apparatus P1.

The contact metal 6 comprises a steel circular body arranged along the previously-described circular stage 311. The contact metal 6 is supported at its lower part by a plurality of springs 61 (elastic bodies) so as to be retractable with respect to the upper end flat surface 312 of the blank holder 31. Like the holding pins 4 or the air pipe 5 shown in FIG. 1B, the contact metal 6 is located between the outer circumference side of the forming convex 21 and the wall of the stage 311 when the forming convex 21 charges into the forming concave 11.

When the die 1 is not moved down, the contact metal 6 is in a state of protruding from the upper end flat surface 312. If the heated steel sheet W is placed on this contact metal 6, then the steel sheet W is held without contact with the blank holder 31 while at the same time only the bridge region Wc is cooled to be in a low temperature hardened state. That is, the contact metal 6 functions as both the holding pins 4 and the air pipe 5 of the forming apparatus P1. The temperature adjustment of the bridge region Wc to be cooled can be performed by varying some parameter, such as the heat capacity of the contact metal 6 and the initial temperature.

The contact metal 6 thus has multiple functions even being simple, and is effective in simplifying the forming apparatus P2. The advantage of improving the formability of the press-formed product F is the same when using the contact metal 6 and using the air pipe 5.

(4) Further, FIGS. 5A to 5D show a forming apparatus P11 which forms a steel sheet W while performing cooling of the bridge region Wc of the steel sheet W and suppression of temperature fall at the flange region Wa. Basic configuration of the forming apparatus P11 is similar to that of the forming apparatus P1. Therefore, the previously-described configuration of the forming apparatus P1 will be omitted.

Figure 5A:
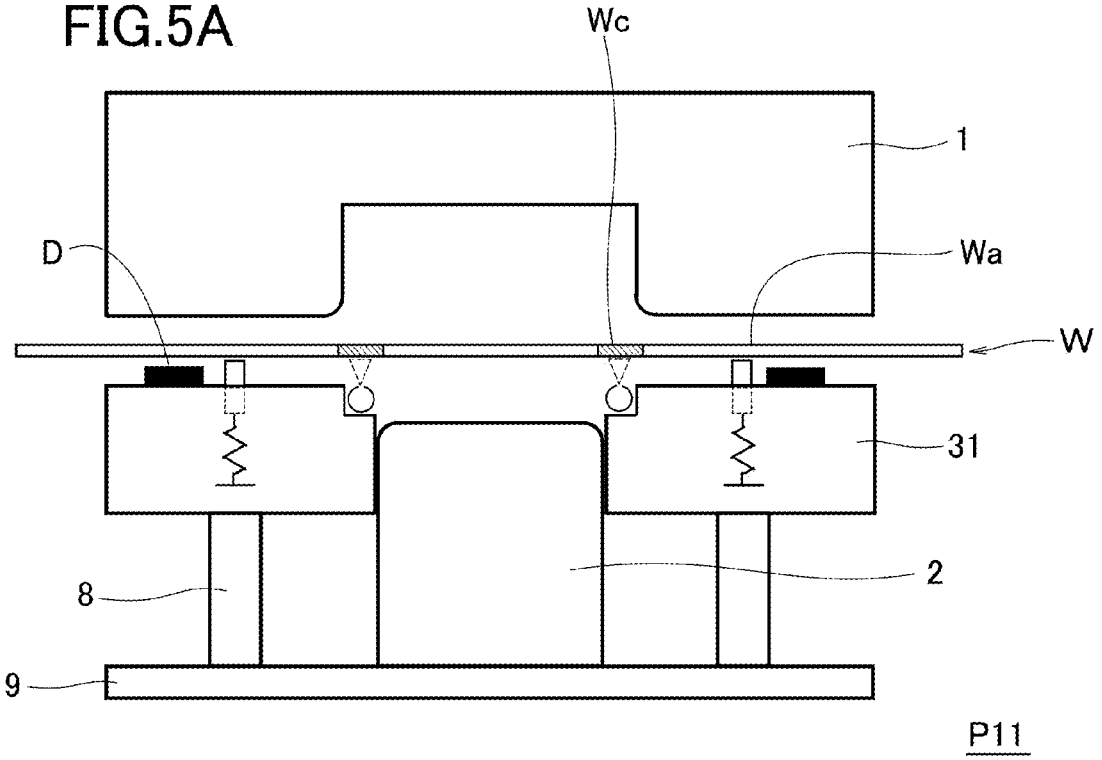
FIG. 5A is a schematic cross-sectional view showing a hot press-forming apparatus in which distance blocks are provided.
Figure 5B:
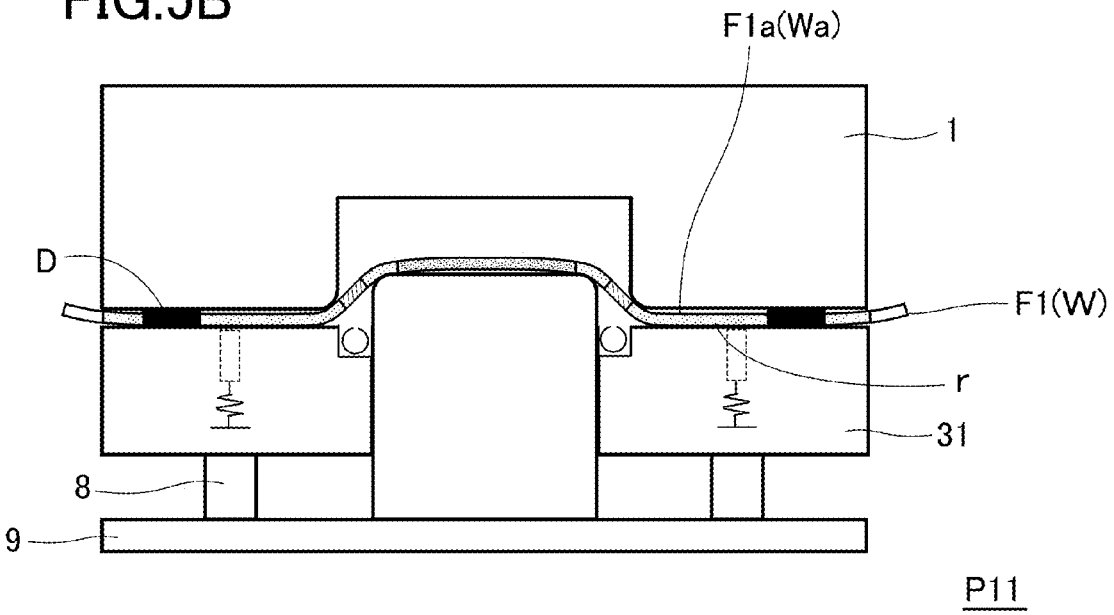
FIG. 5B is a schematic view showing an appearance that the forming apparatus performs hot press-forming (pre-forming).
Figure 5C:
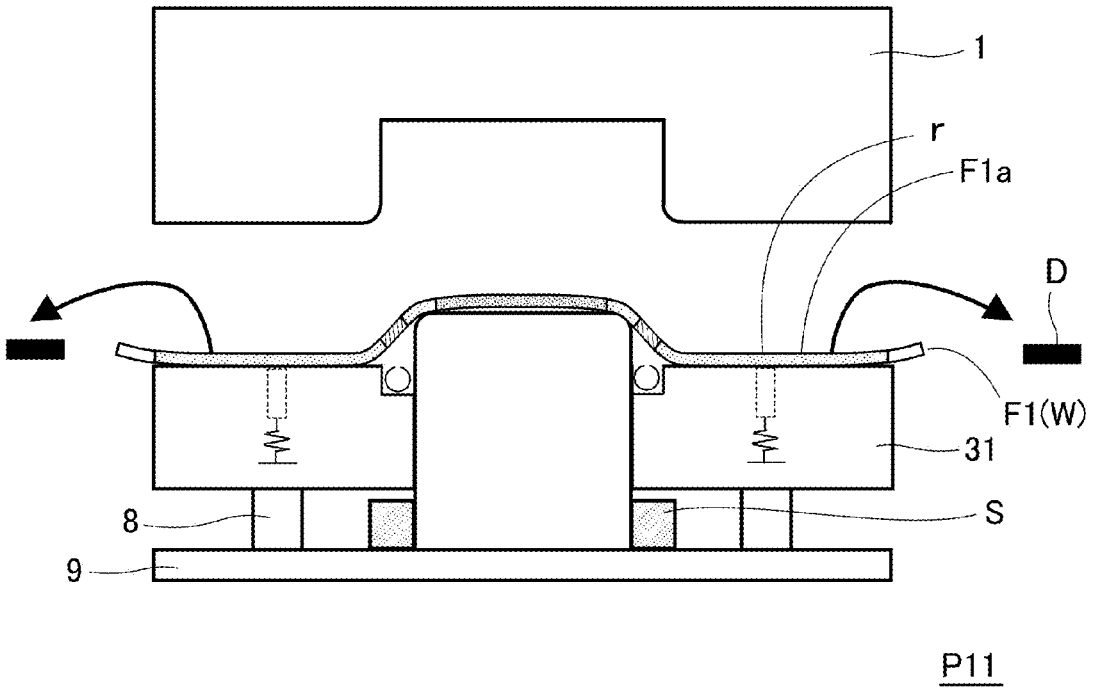
FIG. 5C is a schematic view showing an appearance that the distance blocks are removed from the forming apparatus.
Figure 5D:
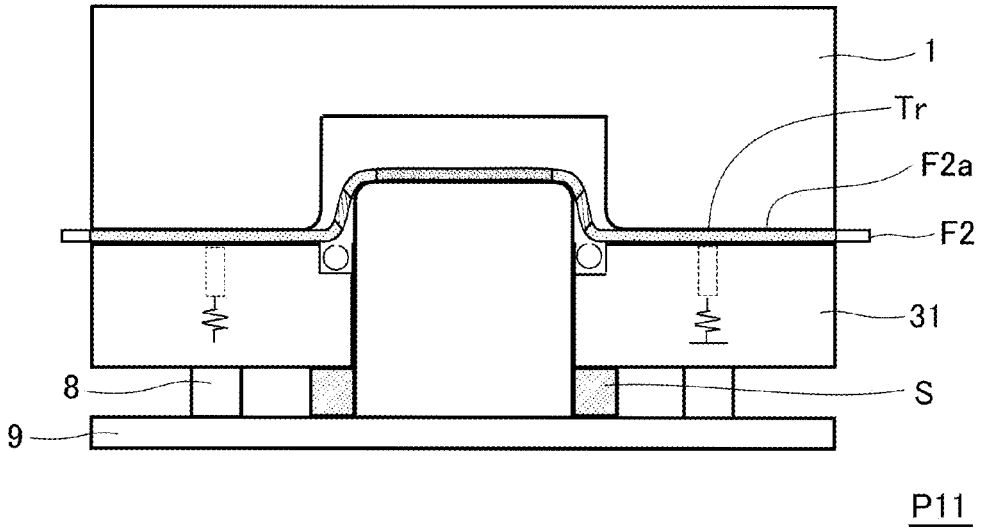
FIG. 5D is a schematic view showing an appearance that stopper blocks are provided to smooth out wrinkles.

The forming apparatus P11 differs from the forming apparatus P1 in the point that the former has distance blocks D (heat removal suppressing means) which can be located between the die 1 and the blank holder 31 during the forming, as shown in FIG. 5A and FIG. 5B, and also has one or more stopper blocks S which can be located between the blank holder 31 and the base 9, as shown in FIG. 5C and FIG. 5D.

As shown in FIG. 5A, before the press-forming, the distance blocks D, which have an appropriate height (thickness) depending on the sheet thickness of the steel sheet W, are located between the die 1 and the blank holder 31. As the die 1 moves downward in this state, the die 1 contacts with the distance blocks D, as shown in FIG. 5B, so that the die 1 and the blank holder 31 move downward while having a clearance due to the distance blocks D which are interposed therebetween. The steel sheet W is formed into a desired shape by the die 1 and the punch 2 while maintaining that state (forming-with-gap step). However, the steel sheet W is press-formed in a state where wrinkles are not sufficiently held by the die 1 and the blank holder 31 within the flange region Wa. This may cause the press-formed product F1 obtained in this stage to be in a state where flange wrinkles r occur. The forming at this stage may be referred to as "pre-forming".

After the pre-forming has been completed, the die 1 is moved to return to a predetermined position, as shown in FIG. 5C, and the distance blocks D are then removed. Further, as shown in FIG. 5D, the stopper blocks S, which have a height depending on a desired depth of the forming, are located between the blank holder 31 and the base 9. As the die 1 moves downward in this state, the die 1 contacts first with the flange portion F1*a* of the press-formed product F1. The flange wrinkles r are then smoothed out by being clamped/pressed between the die 1 and the blank holder 31 (smoothing step). In this state, however, the clamping/pressing force (smoothing force) acting on the flange wrinkles r are not so large due to the action of the die cushions 8.

As the die 1 further moves from such a state, the blank holder 31 being pressed by the die 1 contacts with the stopper blocks S and stops at there. At this stopping position, the die cushions 8 do not act, so that the flange wrinkles r of the press-formed product F1 are strongly pressed between the die 1 and the blank holder 31 by the press force from the die 1 (strongly pressing step). In this way, the flange wrinkles r of the press-formed product F1 are further smoothed out, and a press-formed product F2 is obtained in which at least the flange wrinkles r are removed. Note, however, that the flange portion F2*a* of the press-formed product F2 may be formed with smoothed wrinkle traces which are caused from the flange wrinkles r having been smoothed. The forming at this stage may be referred to as "post-forming". The post-forming may be enough at least if the flange wrinkles r are mitigated or removed. The press-formed product F1 and the press-formed product F2 may have substantially the same form except for presence or absence of the flange wrinkles r, or the press-formed product F2 may otherwise be a product that has been further formed using the press-formed product F1 as material.

The above-described distance blocks D are designed to have a height (h) larger than the sheet thickness (t) of the steel sheet W. The ratio of both (h/t) may appropriately be adjusted, for example, to be more than one and not more than two, and preferably be within a range of 1.2 to 1.6. If the ratio is not more than one, then the steel sheet W is in contact with or pressed to the die 1 and the blank holder 31, and the suppression of temperature fall at the flange region Wa cannot sufficiently be achieved. If, on the other hand, the ratio is unduly large, then the clearance between the die 1 and the blank holder 31 is also unduly large, so that not only the flange wrinkles r grow, but also the forming failure is likely to occur.

«Press-Formed Product»

The press-formed product of the present invention may be further subjected to heat treatment, such as annealing, normalizing, aging, tempering, carburizing and nitriding, or surface treatment, such as plating, or other appropriate treatment. Moreover, the form and use of the press-formed product is not limited. Examples of vehicle components obtained using the press-formed product of the present invention include vehicle body, bumper, oil pan, inner panel, pillar, and wheel house.

EXAMPLES

Example 1

(1) Hot Press-Forming Apparatus

The above-described forming apparatus P1 and the forming apparatus P3 were used to actually form steel sheets W. Each specification of the prepared metal die at that time is as follows. The forming convex 21 of the punch 2 was designed to have: width of 70 mm; longitudinal straight line width of 70 mm; oval pillar-like shape having diameter of both-side semicircles of 70 mm; and shoulder part 21*a* having angled rounded radius (R) of 6 mm. The forming concave 11 of the die 1 was designed to have: width of 84 mm; longitudinal straight line width of 84 mm; oval cylinder-like shape having diameter of both-side semicircles of 84 mm; and angled curved part 11*a* having angled rounded radius (R) of 6 mm. The blank holders 31 and 33 were designed to have: width of 71 mm; longitudinal straight line width of 71 mm; and oval cylinder-like shape having diameter of both-side semicircles of 71 mm. In addition, above the inner circumference side of the blank holder 31 and along its inner wall surface, the air pipe 5 comprising a copper pipe having a diameter of 6 mm was located. The air pipe 5 was provided with spraying holes having a hole diameter of 1 mm at an interval of 10 mm.

(2) Hot Press-Forming

Using the above-described each forming apparatus, a steel sheet W (JIS SCr420 equivalent) of 560 mm×240 mm×t1.4 mm was hot press-formed. The steel sheet W was preliminarily heated to 900 degrees C. (initial temperature) in a furnace (heating step). This steel sheet W was positioned between the die 1 and the punch 2 in a non-contact state (positioning step, non-contact holding step). When the forming apparatus P3 was used, the steel sheet W was held by the holding pins 4 like in the forming apparatus P1.

The temperature of the steel sheet W as a whole was 600 degrees C. when the forming was started. On the other hand, the temperature (particular temperature) at the bridge region Wc cooled using the air pipe 5 of the forming apparatus P1 was 480 degrees C. (particular temperature). Note that the temperature of the steel sheet W as referred to herein is a temperature obtained by measuring the temperature at the center position of the steel sheet using a thermocouple (K type).

After the shoulder part 21*a* of the punch 2 had contacted with the lower surface of the steel sheet W, the hot press-forming was performed while incrementing by 2.5 mm the amount of downward movement of the die 1 (forming step). After being moved to the bottom dead center (stopping position), the die 1 was held for 10 seconds. After this operation, the temperature of the steel sheet W (press-formed product F) became a temperature (end temperature) not higher than 200 degrees C., i.e., lower than the Ms point. In such a way, press-formed products F having various forming heights were obtained. For the case of cooling the particular region (bridge region Wc) (case of using the forming apparatus P1) and the case of not cooling (case of using the forming apparatus P3), the forming height of each press-formed product at the time of breakage or fracture occurring was measured. Results are listed in Table 1. The forming height was obtained from the amount of movement of the press.

Figure 4A:
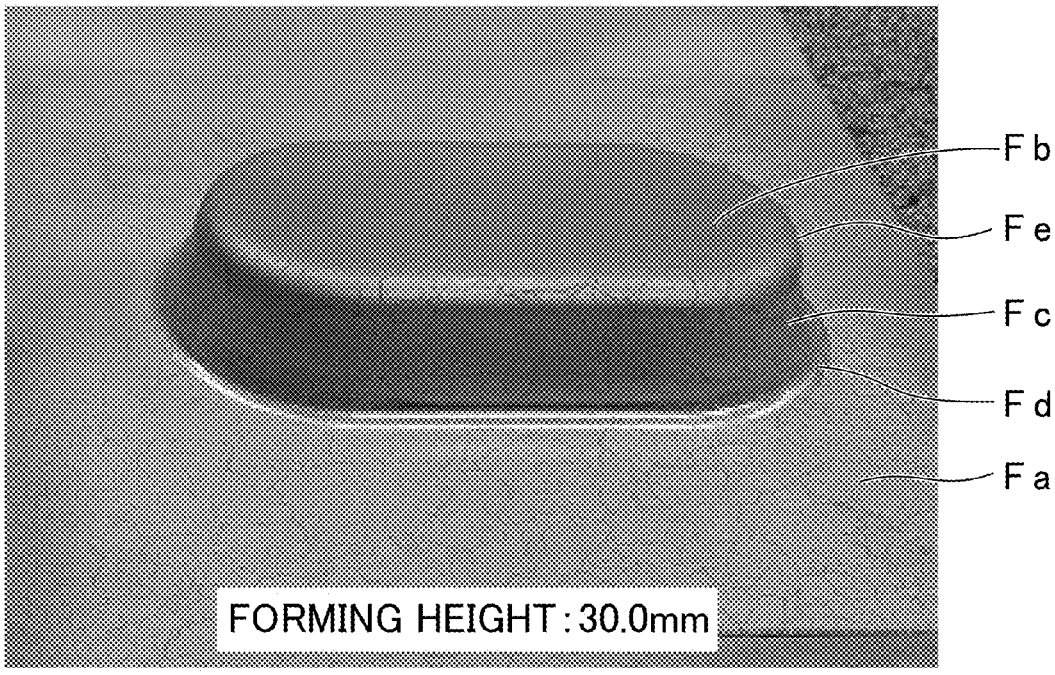
FIG. 4A is a photograph showing one example of a press-formed product produced using a hot press-forming apparatus according to the present invention.
Figure 4B:
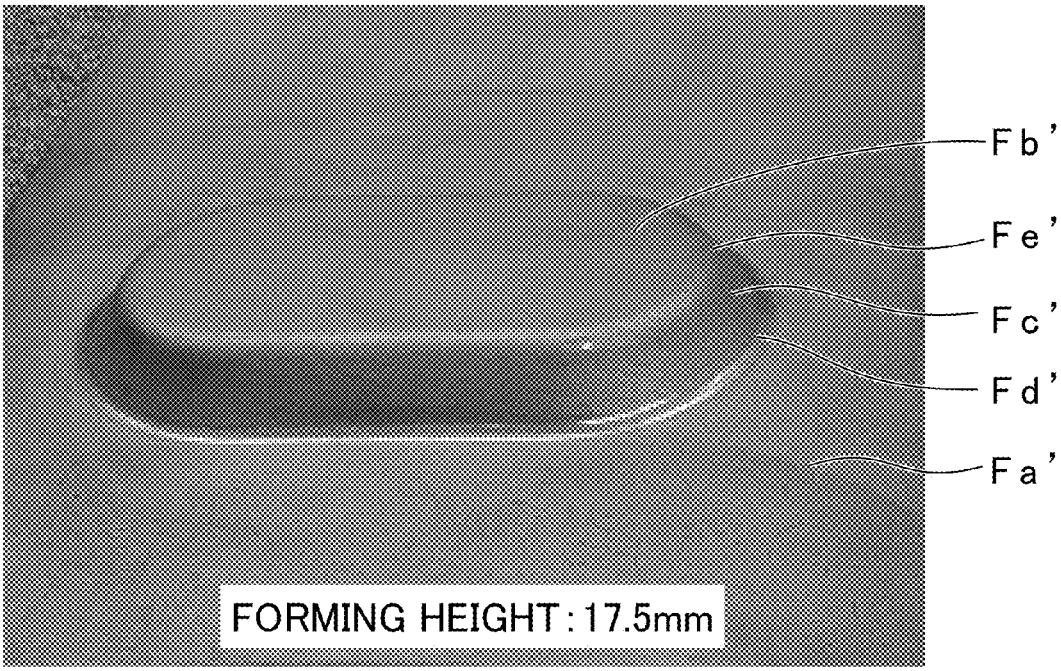
FIG. 4B is a photograph showing one example of a press-formed product produced using a conventional hot press-forming apparatus.

FIG. 4A is a photograph showing one example of the press-formed product F formed using the forming apparatus P1, while FIG. 4B is a photograph showing one example of the press-formed product F' formed using the forming apparatus P3.

In addition, for each press-formed product F, F (including the flange portion Fa, Fa' and excluding the side portion Fc, Fc'), the maximum thickness (t1) and the minimum thickness (t2) were measured to calculate the thickness difference (dt=t1−t2) and the forming ratio (100×dt/t1). Results are also listed in Table 1. The maximum thickness and the minimum thickness were obtained by measuring those on the center line in the lateral direction of each steel sheet using a micrometer.

(3) Evaluation

As apparent from the results listed in Table 1, it has been found that the bridge region Wc of the steel sheet W is cooled thereby to allow the forming height to considerably increase, and the formability can thus be significantly improved. It has also been found that each of the press-formed products F obtained through cooling the bridge regions Wc has a forming ratio of 15% or more, and the steel sheet W was uniformly plastically deformed.

Example 2

(1) Suppression of Temperature Fall at Flange Region

First, using a forming apparatus (refer to FIG. 3A and FIG. 3B) without any cooling means for the bridge region Wc of the steel sheet W and any holder (such as holding pins 4) for the steel sheet W, hot press-forming was performed while interposing distance blocks D between the die 1 and the blank holder 31. At that time, the shape of the metal die used (forming concave of die 1 and forming convex of punch 2) and the composition of the steel sheet W, etc, were modified in some degree, but the hot press-forming was performed essentially according to Example 1.

Figure 6:
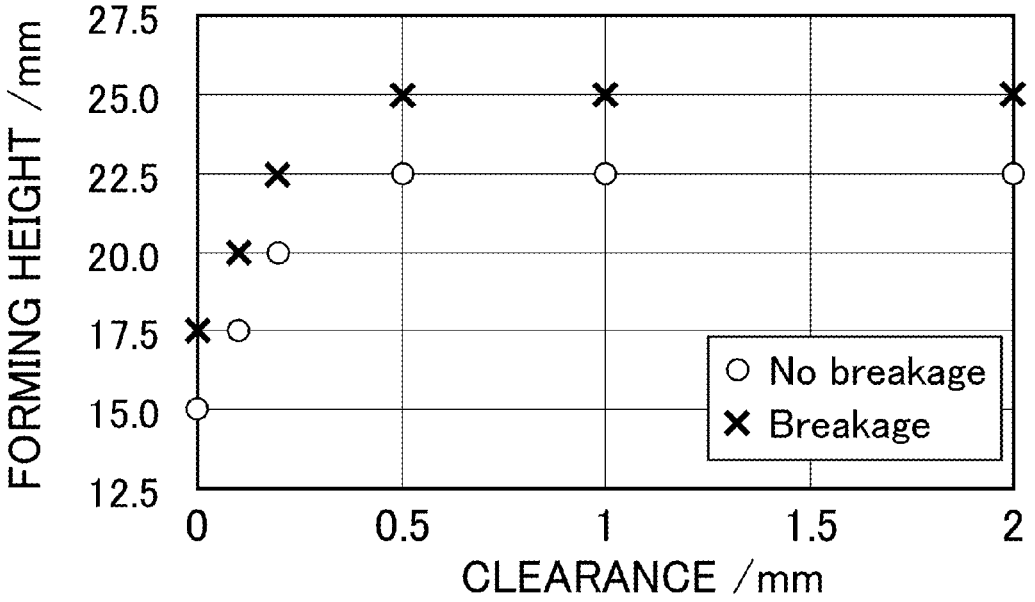
FIG. 6 is a distribution diagram showing a relationship between the amount of clearance and the (critical) forming height when the distance blocks are provided to perform hot press-forming.

While employing various heights (h) of the distance blocks D and repeating hot press-forming for steel sheets W of sheet thickness (t), the relationship was obtained between the amount of clearance formed between the die 1 and the blank holder 31 (c=h−t) and the maximum height of the press-formed product without occurrence of breakage (critical forming height, referred simply to as "forming height"). Results thus obtained are shown in FIG. 6. The amount of clearance of zero in FIG. 6 corresponds to the case where the distance blocks D were not interposed in between. The sheet thickness (t) of the steel sheets W used was 1.4 mm.

As found from FIG. 6, the forming height in the case of no distance block D interposed was 15 mm (refer also to FIG. 7C), but the forming height was improved to 22.5 mm by interposing the distance blocks D. In other words, it has been found that the forming height is improved 7.5 mm by interposing the distance blocks D.

It appears this is because a moderate clearance is formed between the die 1 and the blank holder 31 thereby to suppress the temperature decrease at the held portion (flange region Wa) of the steel sheet W so that material inflow may easily occur from that portion to the bridge region Wc of the steel sheet W (the formed portion F1*a* of the press-formed product F1). However, the forming height takes a peak when the amount of clearance is about 0.5 mm, and further improvement of the forming height may not be expected if the amount of clearance is further increased. It can therefore be said that the amount of clearance between the die 1 and the blank holder 31 may preferably be adjusted 0.3 to 1 mm, and more preferably 0.4 to 0.8 mm.

(2) Cooling of Bridge Region (Particular Region) and Suppression of Temperature Fall at Flange Region First, using the above-described forming apparatus P11, hot press-forming was performed for steel sheet W (sheet thickness: 1.4 mm) almost like in the case of Example 1 by interposing distance blocks D having a height larger by 0.2 mm than the sheet thickness of the steel sheet W (i.e., the above-described amount of clearance was 0.2 mm) between the die 1 and the blank holder 31 (forming-with-gap step, refer to FIG. 5A and FIG. 5B). Through this pre-forming, press-formed product F1 was obtained.

Next, after once returning the die 1 to remove the distance blocks D, stopper blocks S were located between the blank holder 31 and the base 9. In this state, the die 1 was moved downward to a position (bottom dead center) depending on the forming height without reheating the press-formed product F1. The height of the stopper blocks S was adjusted so that the die cushions 8 would not function and the blank holder 31 would be in a locked state at the bottom dead center (stopping position). Through this post-forming, the flange wrinkles r of the press-formed product F1 were strongly pressed between the die 1 and the blank holder 31 to be smoothed out (smoothing step, strongly pressing step). Press formed product F2 having a desired shape was thus obtained (refer to FIG. 7A).

Figure 7A:
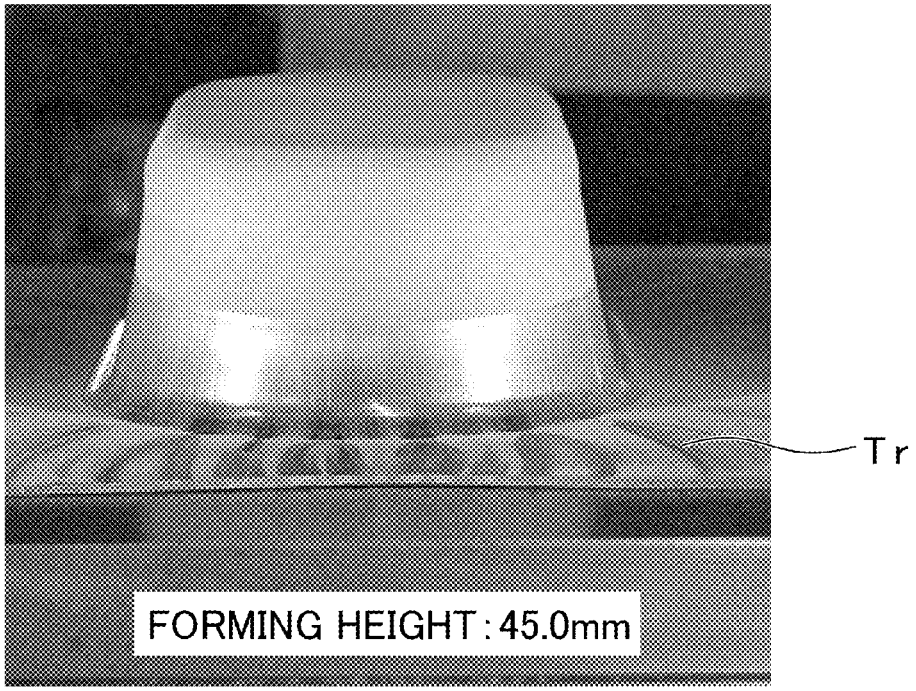
FIG. 7A is a photograph showing a press-formed product that was hot press-formed by performing both the cooling of bridge region of steel sheet and the suppression of temperature fall at the flange region.
Figure 7B:
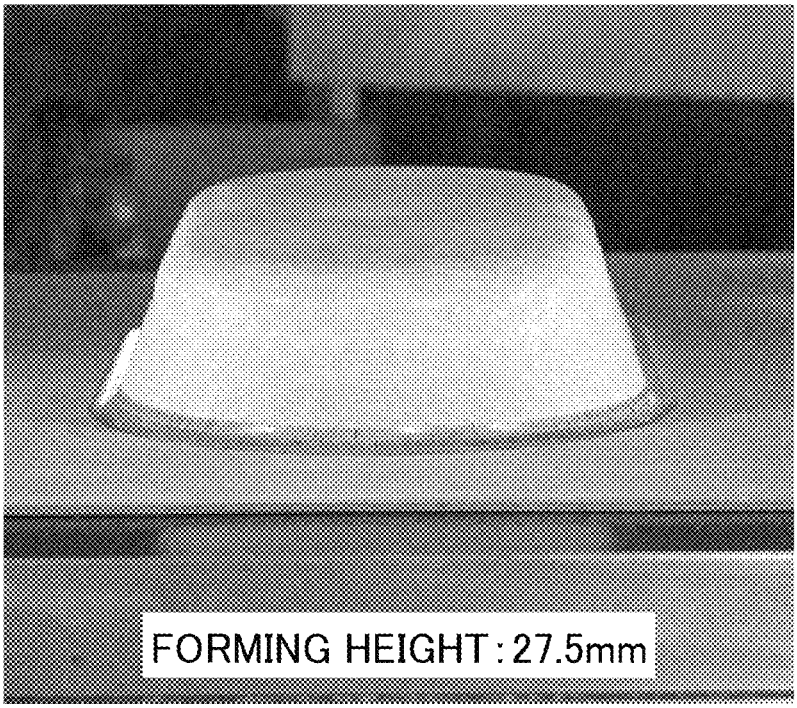
FIG. 7B is a photograph showing a press-formed product that was hot press-formed by only performing the cooling of the bridge region.

Another press-formed product was also produced by performing hot press-forming like in the case of Example 1 using the same forming apparatus P11 but without any distance block D interposed (FIG. 7B).

(3) Evaluation

Figure 7C:
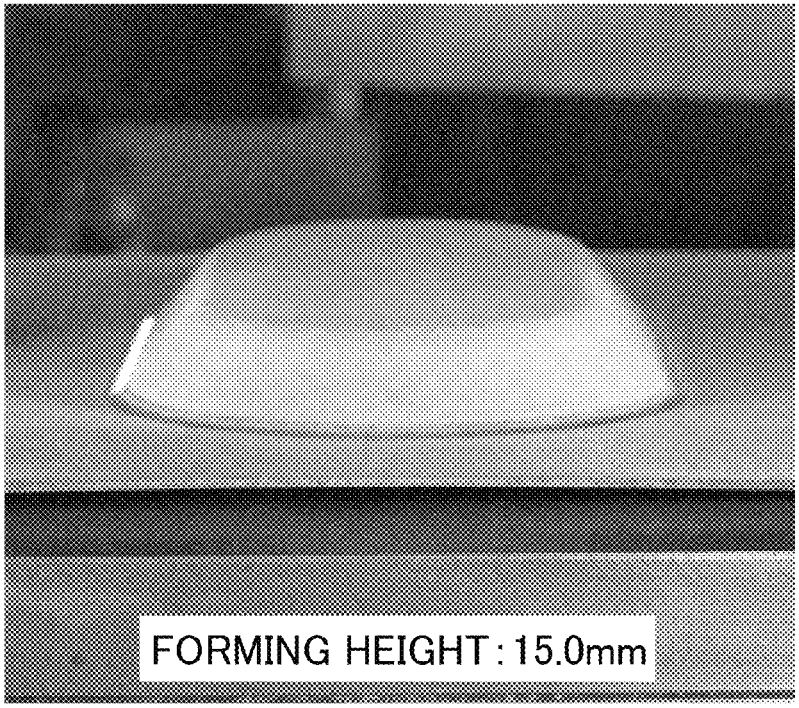
FIG. 7C is a photograph showing a press-formed product that was hot press-formed without performing any of them.

When the cooling of the bridge region and the suppression of temperature fall at the flange region were not performed, the forming height of the press-formed product (referred to as "reference forming height (D0)") was 15 mm, as shown in FIG. 7C. When only the cooling of the bridge region was performed as described in Example 1, the forming height of the press-formed product (referred to as "first forming height (D1)") was 27.5 mm, as shown in FIG. 7B, which was improved 12.5 mm compared with the reference forming height. Further, when both the cooling of the bridge region and the suppression of temperature fall at the flange region were performed as described in the present example, the forming height of the press-formed product (referred to as "second forming height (D2)") was 45 mm, as shown in FIG. 7A, which was improved 30 mm compared with the reference forming height, and improved 17.5 mm compared even with the first forming height.

As apparent from the above, it has been found that the forming height is improved to 1.83 times (D1/D0) only by the cooling of the bridge region, but the suppression of temperature fall at the flange region can be combined therewith to significantly improve the forming height to 3 times (D2/D0).

For reference, as described above, when only the suppression of temperature fall at the flange region was performed, the forming height (referred to as "third forming height (D3)") was 22.5 mm, which was improved 7.5 mm compared with the reference forming height. If respective increases in the first forming height and the third forming height to the reference forming height are simply added, the sum of increases will be 20 mm. On the other hand, increase in the second forming height to the reference forming height is 30 mm. It is thus found that the cooling of the bridge region and the suppression of temperature fall at the flange region are combined to perform the hot press-forming thereby to synergistically enhance the forming height.

(4) Others

It has been confirmed that the use of the above-described forming apparatus improves the critical forming height by 2.5 mm only by increasing the forming speed from 6 spm to 18 spm even without using distance blocks D and cooling the bridge region. Therefore, the cooling of the bridge region and the increase of the forming speed can also be combined to perform the hot press-forming thereby to significantly enhance the forming height.

As found from FIG. 7A, smoothed wrinkle traces Tr formed by smoothing the flange wrinkles r of the press-formed product F1 were observed at the flange portion F2*a* of the press-formed product F2.

TABLE 1

| | | Cooling of particular region: Performed | | | | | Cooling of particular region: Not performed | | | | |
|---|---|---|---|---|---|---|---|---|---|---|---|
| Sample No. | Forming height (mm) | Occurrence of breakage | Maximum thickness t1 (mm) | Minimum thickness t2 (mm) | Thickness difference dt (mm) | Forming ratio (%) | Occurrence of breakage | Maximum thickness t1 (mm) | Minimum thickness t2 (mm) | Thickness difference dt (mm) | Forming ratio (%) |
| 1 | 17.5 | No | — | — | — | — | No | 1.45 | 1.28 | 0.17 | 11.7 |
| 2 | 20.0 | No | 1.46 | 1.30 | 0.16 | 11.0 | Occur | — | — | — | — |
| 3 | 22.5 | No | 1.47 | 1.16 | 0.31 | 21.1 | — | — | — | — | — |
| 4 | 25.0 | No | 1.49 | 1.02 | 0.47 | 31.5 | — | — | — | — | — |
| 5 | 27.5 | No | 1.48 | 0.82 | 0.66 | 44.6 | — | — | — | — | — |
| 6 | 30.0 | No | 1.47 | 0.74 | 0.73 | 49.7 | — | — | — | — | — |
| 7 | 32.5 | Occur | — | — | — | — | — | — | — | — | — |

REFERENCE SIGNS LIST

1; Die
2; Punch
31; Blank holder
4; Holding pin (positioning means)
5; Air pipe (coolant supply pipe, cooling means)
P1; Hot press-forming apparatus
F; Press-formed product
Tr; Smoothed wrinkle trace
r; Flange wrinkle

The invention claimed is:

1. A hot press-forming method to obtain a press-formed product, comprising:

a heating step that heats a steel sheet to an initial temperature not less than an austenite transformation temperature (Ac3 point);

a positioning step that positions the steel sheet between a die having a forming concave and a punch having a forming convex corresponding to the forming concave;

a forming step that press-forms the steel sheet into a desired shape by causing the forming concave of the die and the forming convex of the punch to be close to each other, the steel sheet being held by a blank holder and the die, the punch being inserted in the blank holder, wherein the forming step is a forming-with-gap step that performs the press-forming by setting a gap between the die and the blank holder for the flange region of the steel sheet, the gap being larger than a sheet thickness of the steel sheet by placing a distance block between the die and the blank holder, such that the press-forming is performed without clamping/pressing the flange region of the steel sheet by the die and the blank holder; and after the forming step, returning the die to a predetermined position and then removing the distance block from between the die and the blank holder, the press-formed product comprising a formed portion, the formed portion having a side portion and a top portion, the side portion rising up from an inner circumferential edge area of a flange portion having been held by the die and the blank holder, the top portion stretching from the side portion, the hot press-forming method further comprising a cooling step that cools only a particular region of the steel sheet to a temperature lower than that of regions peripheral to the particular region during a particular time period, the particular region being a region that is to be at least a part of the side portion and is along an inter-edge area formed between an opening circumferential edge area of the forming concave and a top circumferential edge area of the forming convex before the forming step is completed, the particular time period being a time period at least after the heating step has been completed and before the forming step is completed.

2. The hot press-forming method as recited in claim 1, wherein the particular region of the steel sheet is a non-contact region that is not in contact with any of the die and the punch at least when the forming step is initiated.

3. The hot press-forming method as recited in claim 1, wherein the cooling step is a coolant supply step that supplies a coolant to the particular region or a cold body contacting step that causes a cold body to contact with the particular region.

4. The hot press-forming method as recited in claim 1, wherein the positioning step is a non-contact holding step that holds the steel sheet after the heating step so that the steel sheet does not contact with any of the die, the punch and the blank holder.

5. The hot press-forming method as recited in claim 1, wherein:

the cooling step is a step that causes a particular region of the steel sheet to be at a particular temperature higher than a martensite transformation starting temperature (Ms point); and the forming step is a step that causes at least the formed portion to be at an end temperature lower than the Ms point when the forming step is completed.

6. The hot press-forming method as recited in claim 1, wherein the forming step is a heat removal suppressing forming step that performs the press-forming while suppressing heat removal from a flange region of the steel sheet to be the flange portion to the die or the blank holder.

7. The hot press-forming method as recited in claim 1, further comprising a smoothing step that, after removing the distance block from between the die and the blank holder to remove the gap, clamps/presses the flange region of the steel sheet by the die and the blank holder to smooth out a wrinkle caused at the flange region.

8. The hot press-forming method as recited in claim 7, wherein the smoothing step is a strongly pressing step that restrains movement of the blank holder at near a stopping position of the die or the punch to strongly press the flange region by the die and the blank holder.

* * * * *